US007892192B2

(12) United States Patent
Tsukada et al.

(10) Patent No.: US 7,892,192 B2
(45) Date of Patent: Feb. 22, 2011

(54) MASSAGING DEVICE HAVING A CONTROLLER TO GIVE DIFFERENT RECIPROCATING MOVEMENTS TO EACH APPLICATOR ALONG DIFFERENT AXES

(75) Inventors: Daisuke Tsukada, Hikone (JP); Motoharu Muto, Osaka (JP); Takayoshi Tanizawa, Higashiomi (JP); Satoshi Kajiyama, Hikone (JP); Masamichi Miyaguchi, Hikone (JP); Hiroyuki Inoue, Hikone (JP); Masatoshi Dairin, Hikone (JP); Munekiyo Ikebe, Hikone (JP); Yoshiharu Hayashi, Maibara (JP); Masaki Nagano, Katano (JP); Takashi Yukawa, Kyoto (JP)

(73) Assignee: Panasonic Electric Works Co., Ltd., Kadoma-shi (JP)

( * ) Notice: Subject to any disclaimer, the term of this patent is extended or adjusted under 35 U.S.C. 154(b) by 1035 days.

(21) Appl. No.: 11/653,342

(22) Filed: Jan. 16, 2007

(65) Prior Publication Data

US 2007/0167887 A1 Jul. 19, 2007

(30) Foreign Application Priority Data

Jan. 18, 2006 (JP) ..... 2006-010510
Jan. 18, 2006 (JP) ..... 2006-010511
Jan. 31, 2006 (JP) ..... 2006-023593

(51) Int. Cl.
*A61H 15/00* (2006.01)

(52) U.S. Cl. ..... 601/84; 601/86; 601/87; 601/90; 601/99; 601/102; 601/103; 601/116

(58) Field of Classification Search ..... 601/86, 601/87, 93, 97–103, 115, 116, 84, 90, DIG. 18
See application file for complete search history.

(56) References Cited

U.S. PATENT DOCUMENTS 5,792,080 A * 8/1998 Ookawa et al. ..... 601/115

(Continued)

FOREIGN PATENT DOCUMENTS

CN 1466937 A 1/2004

(Continued)

OTHER PUBLICATIONS

Office Action dated Nov. 13, 2009, issued on the corresponding Chinese Patent Application No. 200710002270.6 and the English translation thereof.

(Continued)

*Primary Examiner*—Danton DeMille
(74) *Attorney, Agent, or Firm*—Edwards Angell Palmer & Dodge LLP

(57) ABSTRACT

A massaging device having an applicator driven by a plurality of driving unit to move along two or more different axes to generate a combined massaging action to be applied to the user's body. A controller holds individual speed data each defining a speed at which each of the driving units reciprocates the applicator along each of the different axes, and to control the driving units to reciprocate the applicator in accordance with the associated speed data. The controller controls the speed of the applicator along one of the axes independently from the speed of the applicator moving along another of the axes. Accordingly, the applicator's movements along the different axes can be free from being interfered with each other even being subject to a load, thereby assuring to continue the combined massaging action.

6 Claims, 13 Drawing Sheets

U.S. PATENT DOCUMENTS

| | | | | |
|---|---|---|---|---|
| 5,993,401 | A * | 11/1999 | Inbe et al. | 601/46 |
| 6,224,563 | B1 | 5/2001 | Nonoue et al. | |
| 7,189,211 | B2 * | 3/2007 | Inada et al. | 601/47 |
| 7,429,251 | B2 * | 9/2008 | Tanizawa et al. | 601/94 |
| 2004/0225239 | A1 * | 11/2004 | Yamamoto et al. | 601/84 |
| 2004/0243030 | A1 | 12/2004 | Tanizawa et al. | |
| 2006/0111653 | A1 * | 5/2006 | Nishio et al. | 601/84 |
| 2006/0282026 | A1 * | 12/2006 | Glen et al. | 601/98 |

FOREIGN PATENT DOCUMENTS

| | | | |
|---|---|---|---|
| JP | 59-67950 | | 4/1984 |
| JP | 05-137762 | A | 6/1993 |
| JP | 05-237154 | A | 9/1993 |
| JP | 10-099392 | A | 4/1998 |
| JP | 10-137317 | A | 5/1998 |
| JP | 2001-258972 | A | 9/2001 |
| JP | 2002-238967 | | 8/2002 |
| JP | 2002-345914 | A | 12/2002 |
| JP | 2003-245319 | | 9/2003 |
| JP | 2004-016514 | | 1/2004 |
| JP | 2004-229757 | A | 8/2004 |
| JP | 2004-254732 | A | 9/2004 |
| JP | 2004-350787 | | 12/2004 |
| JP | 2004-350789 | | 12/2004 |
| JP | 2005-130879 | A | 5/2005 |
| WO | WO-01/19316 | A2 | 3/2001 |

OTHER PUBLICATIONS

Decision to Grant a Patent dated May 27, 2008, issued in the corresponding Korean patent application and its partial translation.
Japanese Office Action of JP2006-10511 dated Oct. 6, 2009 and the English translation thereof.
Japanese Office Action of JP2006-10512 dated Oct. 6, 2009 and the English translation thereof.
Japanese Office Action of JP2006-23593 dated Oct. 6, 2009 and the English translation thereof.
Abstract of Decision of Refusal dated Mar. 23, 2010 issued in Japanese Patent Application No. 2006-023593.

* cited by examiner

MASSAGING DEVICE HAVING A CONTROLLER TO GIVE DIFFERENT RECIPROCATING MOVEMENTS TO EACH APPLICATOR ALONG DIFFERENT AXES

FIELD OF THE INVENTION

The present invention is directed to a massaging device, and more particularly to a massaging device having an applicator applying a sophisticated massage action.

DESCRIPTION OF THE RELATED ART

U.S. patent publication 2004-0243030A discloses a massaging device which is configured to give a sophisticated massage action which is a combination of forces acting simultaneously along different axes or directions in order to simulate a human massage. The device is equipped with an applicator which is driven to make different reciprocating movements respectively along different axes, and adopts a control of synchronizing the different movements respectively along the different axes to generate the combined massaging action. Because of a possibly delay in the applicator movement along a particular one of the axes due to a varying load acting back to the applicator from the user's body, there frequently occurs that the applicator has already come to a synchronous point along one of the axes, while the applicator does not come to the synchronous point along another of the axes. Accordingly, the synchronization is required to temporarily stop the applicator's movement along one of the axes for keeping the applicator at a synchronous point until the applicator comes to the synchronous point along another of the axes. During this catch-up period, the applicator moves only along one of the axes, traveling a linear path to generate only a simple massage action, failing to continue the combined massage action.

SUMMARY OF THE INVENTION

In view of the above problem, the present invention has been achieved to provide a massaging device which can keep generating a combined massaging action to apply the sophisticated massage action continuously. The massaging device in accordance with the present invention includes an applicator configured to come into contact with a user's body, and a plurality of driving units coupled to the applicator to give different reciprocating movements to the applicator respectively along two or more different axes, thereby generating a combined massaging action to be applied to the user's body. A controller is included in the device to hold individual speed data each defining a speed at which each of the driving units reciprocates the applicator along each of the different axes, and to control the driving units to reciprocates the applicator in accordance with the associated speed data. The controller is configured to control the speed of the applicator along one of the axes independently from the speed of the applicator moving along another of the axes. Accordingly, the applicator's movements along the different axes can be free from being interfered with each other even being subject to a load, thereby assuring to continue the combined massaging action. Stated from a different point of view, the massage device of the present invention can assure a continuous combined massaging action basically in the absence of any active synchronization between the applicator's movements along the different axes.

Preferably, each of the speed data is prepared as a time-series data in which the speed is defined as a discrete value which varies sinusoidally with respect to time. The resulting sinusoidal displacements along the two axes are cooperative to give a curved or loop path pattern to be traced by the applicator, whereby the applicator gives a smooth massaging action to the user.

The device is preferred to include a speed sensor configured to monitor the speed of the applicator moving along each of the axes. In this connection, the controller is configured to control the speed of the applicator in a feedback manner based upon the speed monitored with respect to each of the reciprocating movement along each of the different axes. Thus, it is possible to restrain the fluctuation of the speed irrespective of a varying load acting on the applicator, thereby assuring to move the applicator along an intended path.

It is also preferred that the speed data of the reciprocating movement along one of the axes is configured to give a reverse point which is shifted with respect to time in relation to the reciprocating movement along another of the axes. With this result, the applicator traces a loop path to give a massage action simulating a point kneading massage.

In addition, the speed data of the reciprocating movement along one of the axes may be configured to have a reciprocating cycle which is different from that of the speed data of the reciprocating movement along another of said axes. With this scheme, the amount of phase shift between the movements along the different axes is caused to vary with respect to time, thereby continuously varying a massaging pattern or path to be traced by the applicator for enhancing a massaging effect.

Further, the speed data of the reciprocating movement along at least one of the axes may be configured to define different maximum values for forward and backward movements of the applicator, giving different amounts of the forward and backward movements along the at least one of the axes.

The device may include a position sensor configured to detect a position of the applicator reciprocating along each of the exes. In this connection, the controller is configured to stop reciprocating the application along each of the axes when the position sensor detects the position corresponding to an end position determined for the movement along each of the axes. In other words, the applicator is driven to move to the individual end positions respectively defined along the different axes until the applicator is completely stopped, whereby the applicator can be stopped exactly at an intended end point. Consequently, a subsequent massaging action can start consistently from the intended end point.

The end position for the movement of the applicator along one of the axes can be selected to a position which lies on a tangent line of a path which is traced by the applicator moving along another of the axes. The end position on the tangent line is a far from any point of the path and define the end point along one of the axes which is reached later than the end point along any other axis or axes. Thus, when the applicator is controlled to trace the loop path of giving the point kneading massage, the applicator is stopped only after completely tracing the loop path and without going inside the loop path in order to avoid jerky and unpleasant massaging action.

In a preferred embodiment, the controller is configured to start reciprocating the applicator along two of the axes concurrently and to reverse the reciprocating movement along one of the two axes while moving the applicator in one direction along the other axis. With this control, the applicator can traces a loop path for simulating the point kneading massage to be applied to the user's body.

It is preferred that the speed data for the reciprocating movement of said applicator along two of said axes are configured to vary the speed respectively along sinusoidal curves. In this case, one of the sinusoidal curves having a phase shifted by 45° to 90° with respect to that of the other sinusoidal curve for moving the applicator along a circular path.

For applying an effective loop massage action to a small restricted portion, for example, a portion around a shoulder blade, the sinusoidal curves for the respective movements along the two axes may be selected to give a loop path having a diameter of 20 mm or less.

Also, it is preferred for the applicator to trace a path of which shape varies continuously with respect to time in order to give an effective massage of continuously changing patterns. For this purpose, each of the sinusoidal curves for the respective movement along the two axes may be configured to vary at least one of its cycle and amplitude with respect to time. In this connection, each of the sinusoidal curves may be selected to have a cycle of 2 seconds or less.

Further, it is preferred to move applicator in a circular path while moving the circular path along another path in order to give the point kneading massage continuously over an elongated portion of the human body. In this case, the sinusoidal curves for the respective movements along the two axes are selected to give a continuously coiled loop path to be traced by said applicator with the continuously loop path having a center point moving along one of the two axes.

Still further, the massaging device of the present invention may be so configured to give a three-dimensional massage action effective for relaxing the user's body. For achieving the three-dimensional massage action, the controller is configured to hold an additional speed data for reciprocating the applicator along an additional axes perpendicular to each of the two axes. The additional speed data is selected to give a three-dimensional path to be traced by the applicator.

These and still other advantageous feature of the present invention will become more apparent from the following detailed description of the embodiments when taken in conjunction with the attached drawings.

DETAILED DESCRIPTION OF AN EXEMPLARY EMBODIMENT

Figure 1:
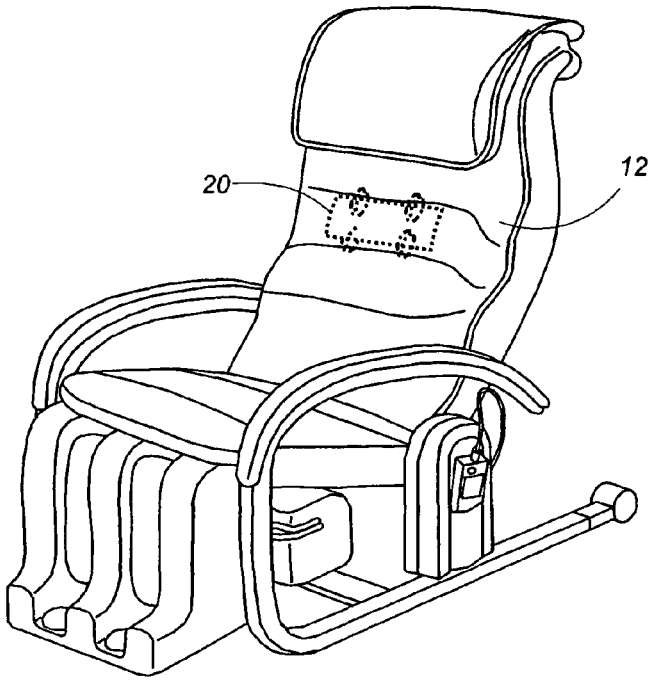
FIG. 1 is a perspective view of a massaging device in accordance with a preferred embodiment of the invention.

Referring to FIGS. 1 to 6, there is shown a massaging device in accordance with an exemplary embodiment of the present invention. The massaging device is realized in the form of a chair having a framework or base 10 carrying a massage module 20 embedded in a backrest 12 of the chair. The massage module 20 is supported on the base 10 and is vertically movable along the length of the backrest 12. The massage module 20 includes a pair of applicators 30 each composed of a set of vertically spaced rings which are supported to a cradle 32 so that, as will be discussed later in detail, the applicators 30 are movable relative to the massage module 20 along as well as about a lateral axis X of the module 20. As the module 20 itself is movable in the vertical direction relative to the base 10, the applicators are given three (3) degrees of freedom relative to the base 10, i.e., a lateral translational movement Tx along the lateral axis (x-axis), a vertical translational movement Ty along a height axes (y-axis) of the base 10, and a rotational movement Rx about the lateral axis (x-axis). The rotational movement Rx of the applicator inherently includes a depth translation Tz along a depth axis (z-axis) perpendicular to the x- and y-axes. One and suitable combinations of these movements are selected to give a massaging force in various patterns to different portions of the user's body. Only for sake of simplicity, the term "applicator" is used in the claims and other portions of the description to collectively refer to the applicators 30 in the sense that it applies the massaging force to the user.

Figure 2:
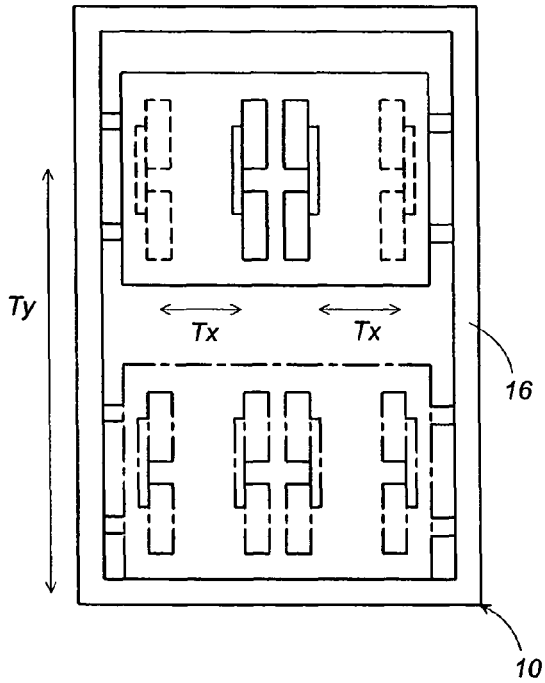
FIGS. 2 and 3 are schematic views of a massage module employed in the above device.
Figure 3:
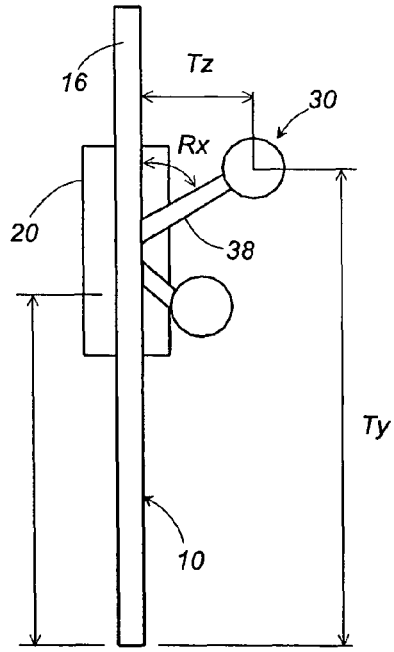

The applicator 30 is driven by controlling three independent driving units or motors 41, 42, and 43 to reciprocate along the different axes (x-, y-, and z-axes). FIG. 2 shows the lateral and vertical translational movements Tx and Ty of the applicator 30 relative to the base 10, developing the corresponding massaging forces being applied to the user's body along the x- and y-axes. FIG. 3 shows the rotational movement Rx of the applicator 30 relative to the module 20 and therefore the base 10, with associated depth translational movements Tz for applying a corresponding massaging force to the user's body with varying pressing strength.

Figure 4:
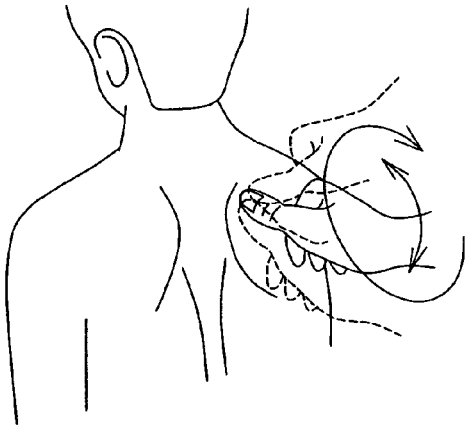
FIG. 4 is a schematic view illustrating a human hand massage simulated by the massaging device.
Figure 5:
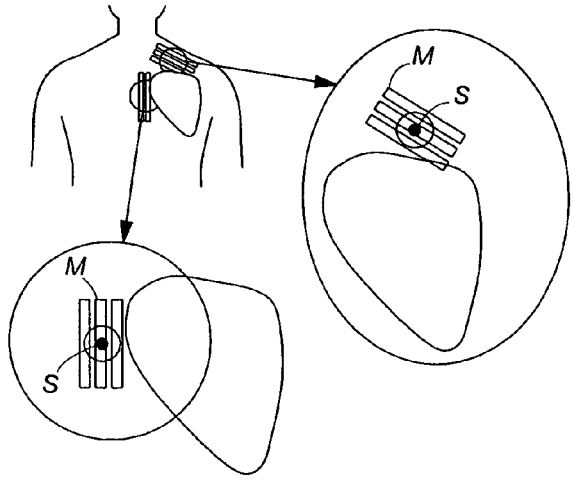
FIG. 5 is a schematic view illustrating a massage action performed by the massaging device.
Figure 6:
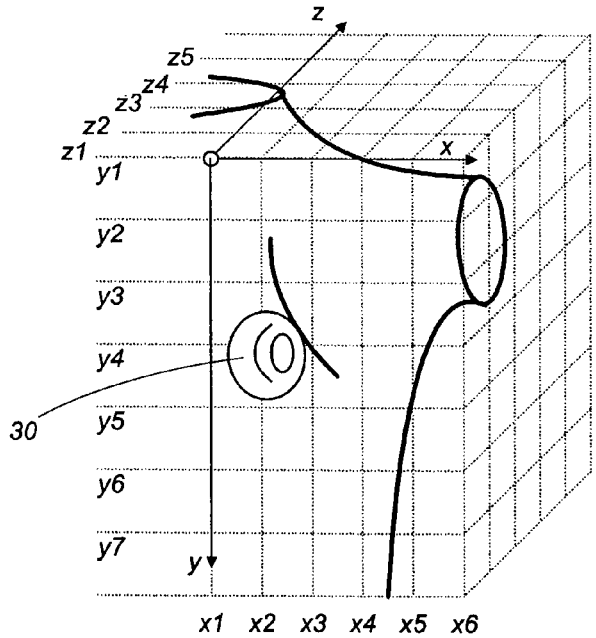
FIG. 6 is a schematic view illustrating the applicator in relation to a user's body contour in three-dimensional coordinates.

The three individual reciprocatory movements are suitably combined to develop the massage force in various massage patterns, for simulating human touch massage actions including rubbing, kneading, and combinations thereof. The device is configured to allocate the massage patterns to different parts of the body, and is particularly designed to have a function of giving a point kneading massage to a small portion, e.g. around a shoulder blade as simulating a human hand massage, as shown in FIG. 4. In the following description, it is explained that the applicator 30 is controlled to trace basically a loop or circular pattern for relaxing a stiffened part (S) present in a muscle bundle (M), as shown in FIG. 5. In order to locate the applicator to a desired portion of the body, the device is provided with various position sensors for determining the current position of the applicator 30. The current position of the applicator 30 is expressed within three-dimensional coordinates, as shown in FIG. 6, in relation to the user's body contour which is obtained and is stored in the device.

Figure 7:
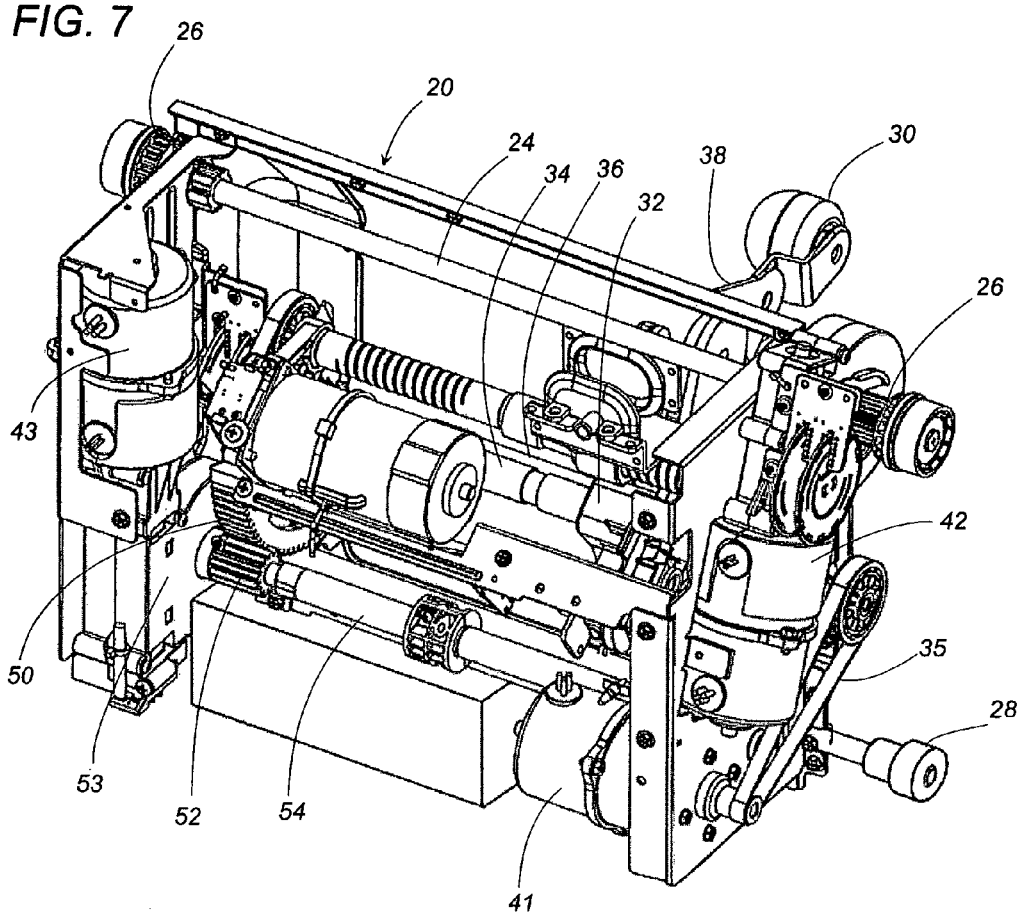
FIG. 7 is a perspective view of the massage module.

Prior to discussing a controlled operation of the applicator, a mechanism of driving the applicator 30 is explained with reference to FIGS. 7 and 8. The massage module 20 has a chassis 22 carrying the three electric motors 41, 42, and 43, in addition to the cradles 32 each mounting the applicators 30 by means of arms 38 (only one of the cradles is shown in FIG. 7). The chassis 22 includes a horizontally extending drive shaft 24 formed at its opposite ends with gears 26 which mesh respectively with vertical racks 16 of the base 10. The drive shaft 24 is driven by the motor 42 to reciprocate the module 20 vertically along the length of the base 10, thereby making the vertical movement Ty of the applicator 30 along the x-axis. Guide rollers 28 are mounted to the chassis 22 in vertically spaced relation to the gears 26, and are kept in rolling contact with the racks 16 for vertically guiding the module 20.

The cradles 32 are engaged with a common screw shaft 34 in a laterally spaded relation with each other so as to effect the lateral translational movement Tx in such a manner that the cradles 32 moves toward and away from each other as the screw shaft 34 rotates in the opposite directions, respectively. The screw shaft 34 is connected to the motor 41 by means of a belt 35 so as to be driven to rotate thereby.

Figure 8A:
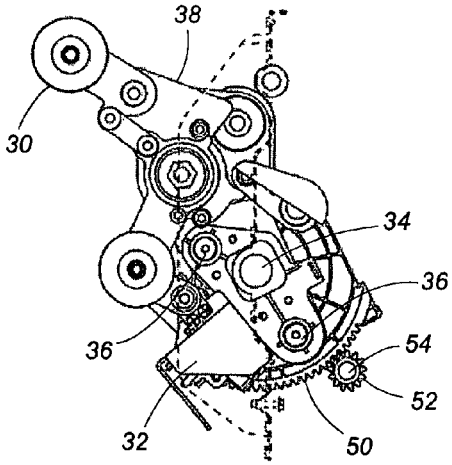
FIGS. 8A and 8B illustrate one particular movement of the applicator.
Figure 8B:
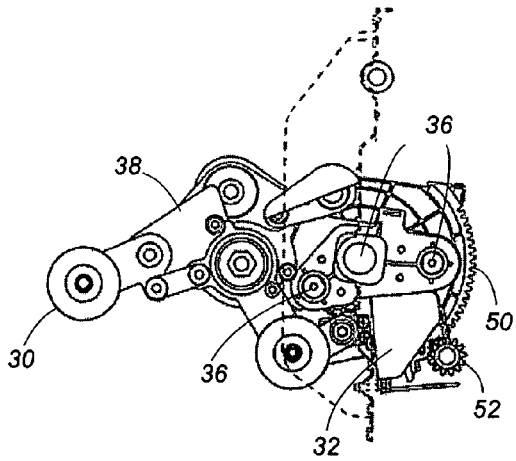

The cradle 32 is supported to a pair of horizontal axles 36 which extend between horizontally spaced swing gears 50 in parallel with the screw shaft 34. Each swing gear 50 is a fan-shaped gear pivotally supported at its center to the screw shaft 34 and is fixed to the axles 36. The swing gears 50 mesh respectively with pinions 52 formed at opposite ends of a horizontal shaft 54 driven by the motor 43 through a gear box 53 so that the swing gears 50 causes the cradles 32 and therefore the applicator 30 to pivot about the axis of the screw shaft 34 as the motor 43 rotates in the opposite directions, thereby reciprocating the applicator 30 about the x-axis with an associated transitional movement along the z-axis, as shown in FIGS. 8A and 8B.

Thus, the applicator 30 can be driven by the individual motors 41, 42, and 43 to effect the reciprocal translational movements Tx, Ty along the three axes (x-, y-, and z-axes) in any combination determined by a controller 100 included in the device, thereby producing composite massage forces of the different massage patterns.

Figure 9:
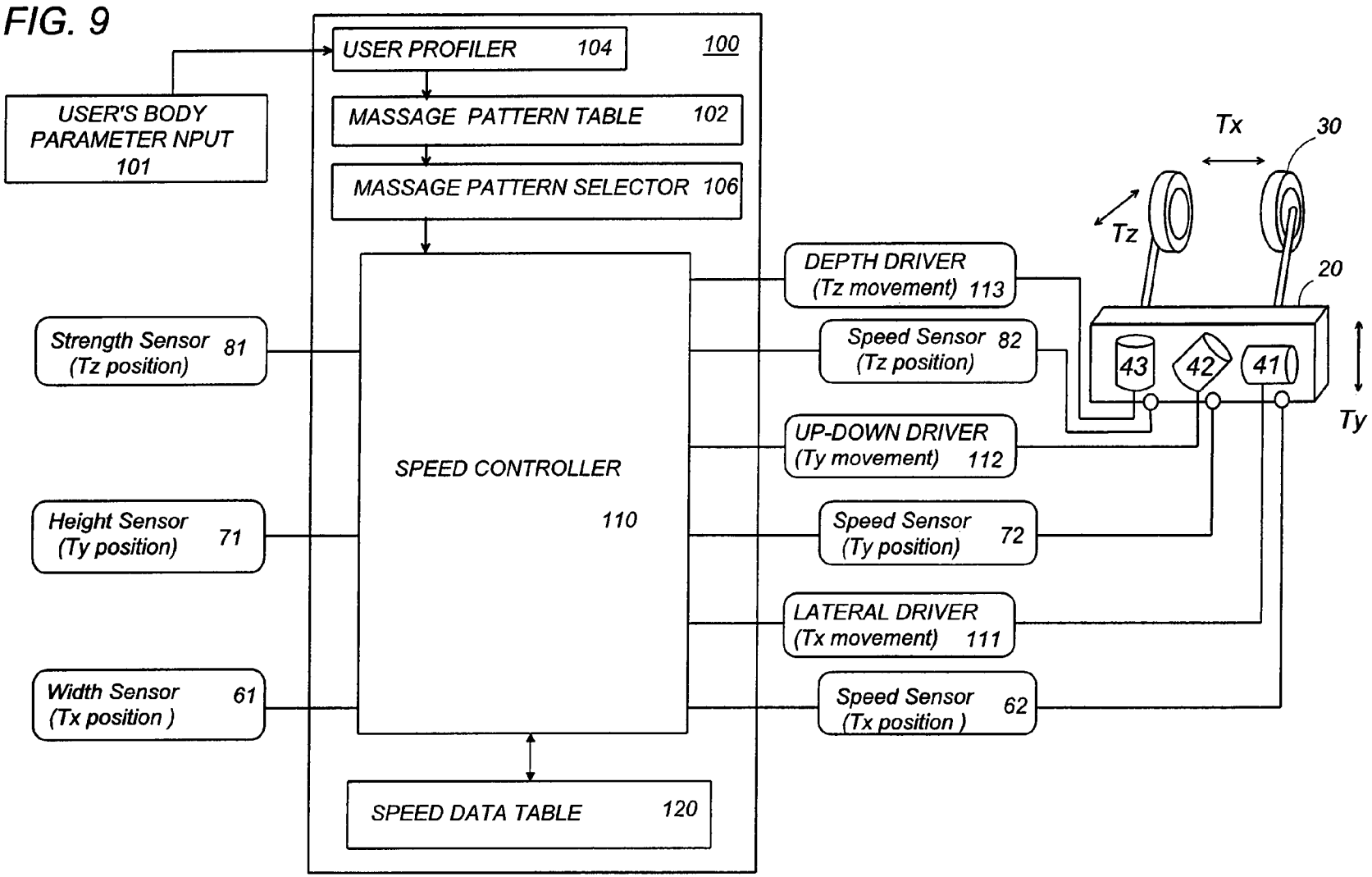
FIG. 9 is a block diagram illustrating a circuit arrangement of the above device.

Further, as schematically shown in FIG. 9, the device includes a width sensor composed of a position sensor 61 and a speed sensor 62 respectively for detection of the current position and speed of the applicator 30. The position sensor 61 is disposed adjacent the center of the screw shaft 34 for monitoring the lateral translational movement Tx of the cradle 32, i.e., the applicator 30, while the speed sensor 62 is disposed adjacent the motor 41 for monitoring the displacement speed of the applicator in terms of the rotation speed of the motor. Also, the device includes a height sensor composed of a position sensor 71 disposed adjacent one of the gears 26 for monitoring the vertical translational movement Ty of the module 20 in relative to the base 10, and a speed sensor 72 disposed adjacent the motor 42 for monitoring the traveling speed of the massage module 20, i.e., the applicator 30 in terms of the rotation speed of the motor 42. Further, the device is provided with a strength sensor composed of a position sensor 81 disposed adjacent the one of the swing gears 50 for monitoring the rotational movement Rx of the cradle 32 about the screw shaft 34, i.e., the translational movement Tz along the depth axis (z-axis), and a speed sensor 82 disposed adjacent the motor 43 for monitoring the speed of the applicator 30 in terms of the rotation speed of the motor 43.

Now, the control of the device is explained with reference to FIG. 9. The controller 100 is provided to control the motors 41, 42, and 43 for realizing the different massage patterns as mentioned in the above. Basically, the controller 100 is configured to move the applicator 30 vertically in a predetermined schedule to cover the length of the user, for example, between the neck to the waist, while controlling the applicator 30 to stay at the different body parts, i.e., neck, shoulders, back, and waist for a predetermined time period in order to effect the local massages.

Included in the controller 100 is a massage pattern table 102 which allocates the different massage patterns to different body parts, and which correlates the individual body parts respectively with ranges that are different from users of different body shapes. The massage pattern table 102 is configured to have records each related to one of the body parts, with each record giving the particular massage pattern and the ranges describing the body part with numerical values for lower and upper limits with regard to the length, width, and depth dimensions.

The numerical values are variables that vary with the users of different body shapes. In order to customize the device for each of different users, the device includes a user profiler 104 which receives from a user's body parameter input 101 a parameter identifying a user's body shape and estimates the locations of the respective body parts. That is, the user profiler 104 determines and gives the numerical values to the pattern table 102 that designate the ranges of the body parts specific to the particular user. The user's body parameter input 101 is realized by a key pad where the user can enter the characteristic value such as height or the like identifying the shape of the user's body. Initially, the pattern table 102 is set to have the numerical values which designate a standard body shape.

The controller 100 includes a massage pattern selector 106 which acknowledges the current position of the applicator 30 from the outputs of the sensor 61 to determine which one of the body parts meets the applicator 30 with reference to the pattern table 102, and selects the massage pattern allocated to thus determined body parts. Then, the massage pattern selector 106 activates or deactivates a driving circuit provided for driving the motors 41, 42, and 43, thereby reciprocating the applicator 30 in match with the selected massage pattern. The driving circuit includes a lateral driver 111 which drives the motor 41 to effect the laterally reciprocating translational movement Tx of the applicator 30, an up-down driver 112 which drives the motor 42 to effect the vertically reciprocating translational movement Ty of the applicator 30, and a depth driver 113 which drives the motor 43 to effect the reciprocatory translational movement Tz of the applicator 30. In making the respective transitional movement Tx, Ty, and Tz, the massage pattern selector 106 refers to the pattern table 102 to find the allowed ranges of the movements, while monitoring the current position of the applicator 30 by the sensors 61, 71, and 81, in order that a speed controller 110 actuates the respective drivers 111, 112, and 113 for reciprocating the applicator 30 at controlled speeds independently from each other to make the massage of an intended pattern, as will be discussed hereinafter.

Figure 11:
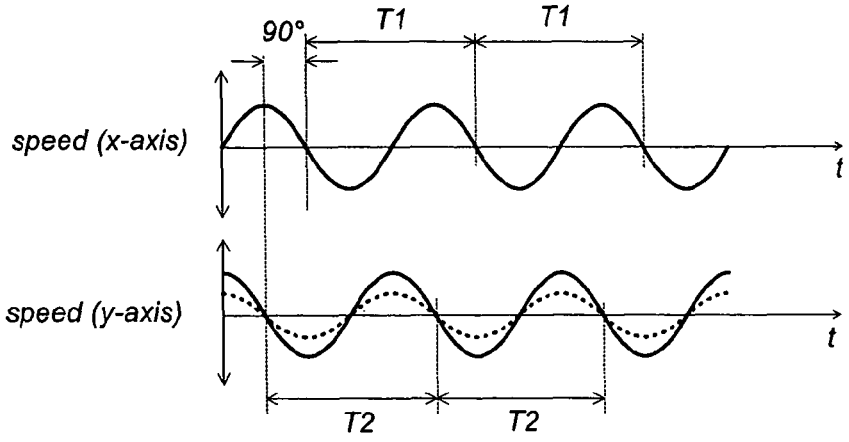
FIG. 11 is a waveform chart illustrating speed data by which the applicator is driven to reciprocate.

The controller 100 includes, in addition to the speed controller 110, a speed data table 120 which holds three sets of speed data for each of the transitional movements Tx, Ty, and Tz respectively along the three axes (x-, y-, and z-axes). Each speed data designates a speed of the applicator moving along each of the three axes (x-, y-, and z-axes), and is prepared as a time-series data in which the speed is defined as a discrete value varying sinusoidally with respect to time. FIG. 11 shows one example of the speed data for making the massage of a circular pattern which simulates the point kneading massage.

Figure 10:
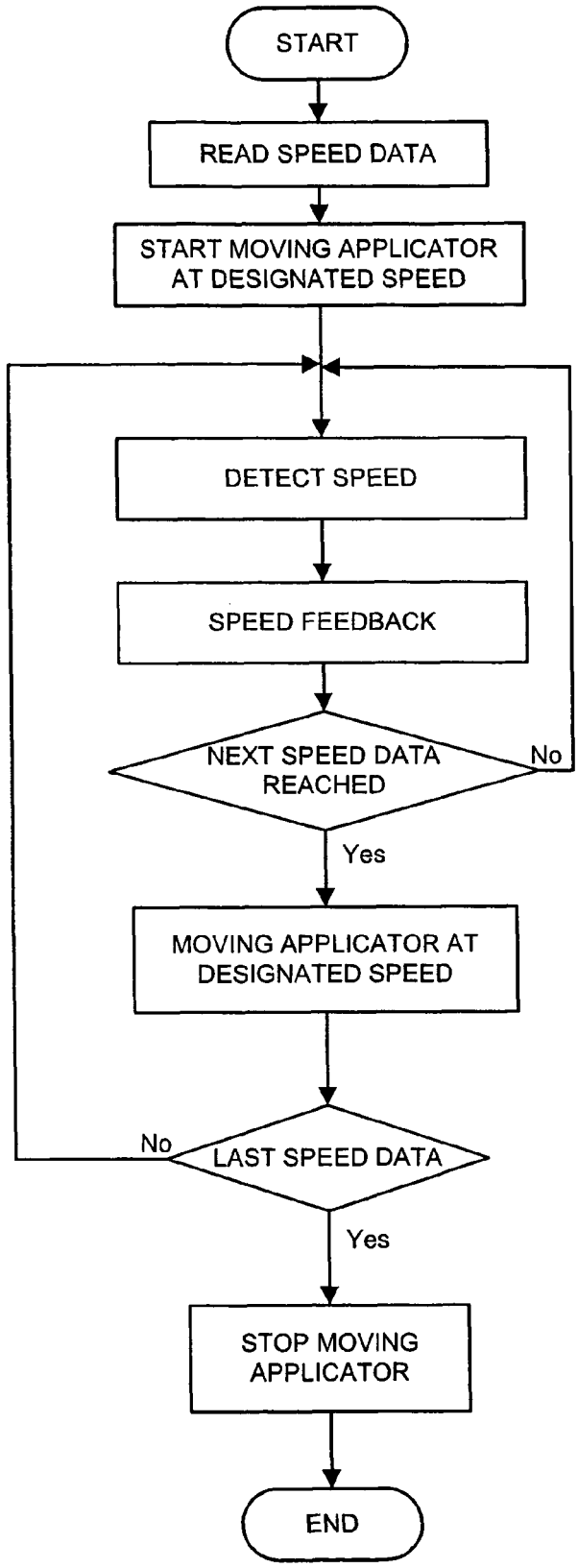
FIG. 10 is a flowchart illustrating a basic operation of the device.

FIG. 10 shows a flow-chart illustrating the steps that the speed controller 110 executes for making the massage in accordance with the speed data. Firstly, the speed controller 110 reads the speed data from the speed data table 120 in match with the selected massage pattern, and activates the individual driving units or motors 41 to 43 for reciprocating the applicator 30 at the speeds designated by the speed data respectively along the three axes. While moving the applicator 30, the speed sensors 62, 72, and 82 provide the individual speeds of the applicator along the three axes such that the speed controller 110 repeats a feedback control of moving the applicator at the speed as close as the designated speed until the next discrete speed data is reached. Such feedback control is made for subsequently read speed data until the speed controller 110 reads the last speed data. Upon reaching the last speed data, the speed controller 110 stops moving the applicator 30.

Figure 12A:
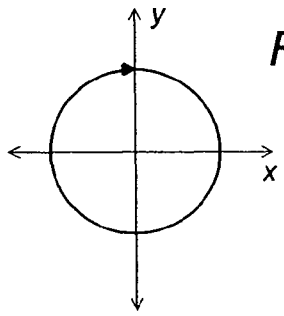
FIGS. 12A and 12B are schematic views respectively illustrating a loop path or massage pattern along which the applicator moves.
Figure 12B:
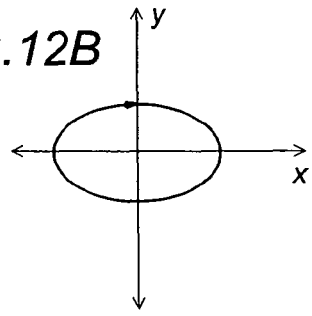

Now, the operation of the device is discussed in terms of an intended massage pattern. When it is intended to move the applicator along a loop path as shown in FIGS. 12A and 12B for simulating the human point kneading massage, the speed data for the movement Tx and Ty respectively along the x- and y-axes are each selected to give a sinusoidal waveform, as shown in FIG. 11. The sinusoidal waveforms of the speeds along the x-axis and y-axis have the same cycle (T1=T2) with a phase shift of 90° When the sinusoidal waveforms are selected to have the same amplitude, the resulting loop path becomes circular as shown in FIG. 12A, while one of the sinusoidal waveforms of the speed, for example, along the y-axis, is selected to have the amplitude less than the other sinusoidal waveform, as indicated by dotted lines in FIG. 11, the resulting loop path becomes elliptical, as shown in FIG. 12B. Preferably, the cycle and the amplitude of the speed data are selected to give the loop path within a square of 20 mm and to trace one loop path in 2 seconds or less. The loop path having a diameter of 20 mm or less is selected to give a concentrated massage force effectively to a stiffened part present within a muscle bundle to have a diameter of 10 mm or less.

Figure 13:
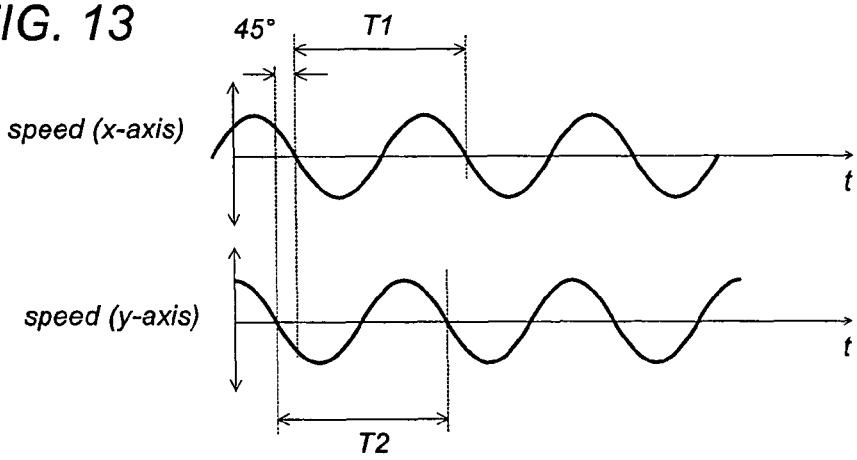
FIG. 13 is a waveform chart illustrating another speed data.
Figure 14:
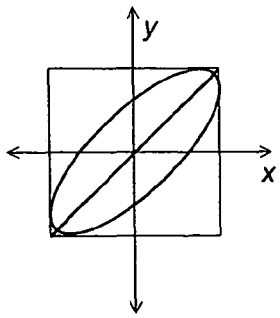
FIG. 14 is a schematic view illustrating the massage pattern resulting form the speed data of FIG. 13.
Figure 15:
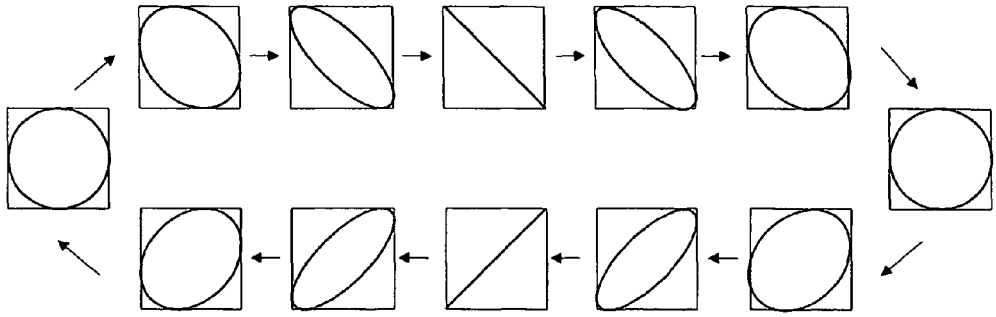
FIG. 15 is a schematic view illustrating a changing massage pattern realized by the above device.

When the sinusoidal waveforms for the speeds along the x- and y-axes are selected to have a phase shift of 45°, as shown in FIG. 13, the applicator 30 traces the loop path of an inclined ellipse within a square as shown in FIG. 14. As the phase shift becomes smaller towards zero, the loop path becomes more flattened and eventually converted into an inclined straight line, as shown in FIG. 14. Accordingly, it is possible to vary the massage pattern between the circle to a straight line through the ellipse, as shown in FIG. 15, by varying the amount of the phase shift between 90° to 0°.

Figure 16:
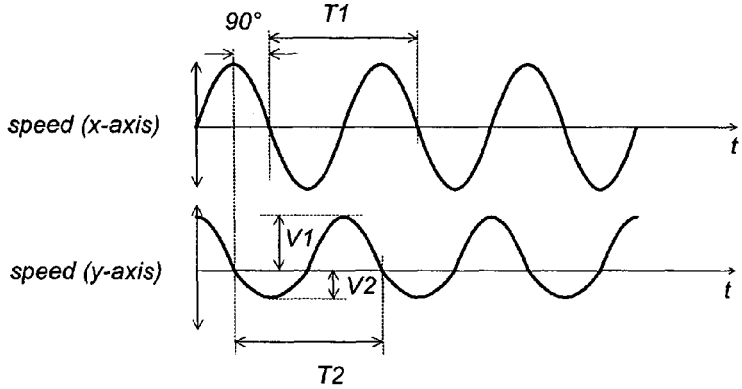
FIG. 16 is a waveform chart illustrating another speed data.
Figure 17:
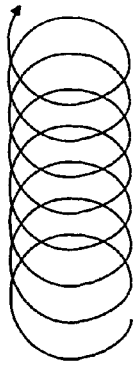
FIG. 17 is a schematic view illustrating a progressive massage pattern resulting from the speed data of FIG. 16.
Figure 18:
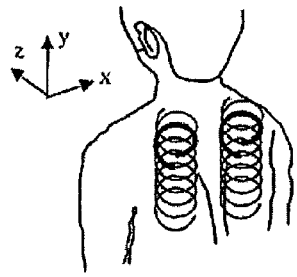
FIG. 18 is a schematic view illustrating the massage action being applied to the user's body.
Figure 19:
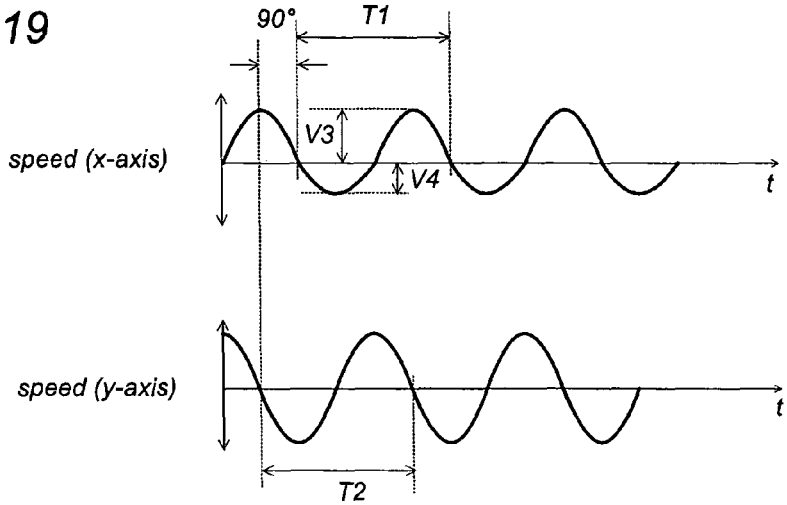
FIG. 19 is a waveform chart illustrating a further speed data.
Figure 20:
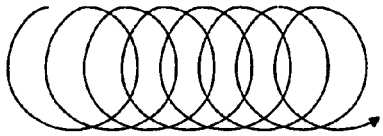
FIGS. 20 and 21 are schematic views illustrating a progressive massage pattern resulting from the speed data of FIG. 19.
Figure 21:
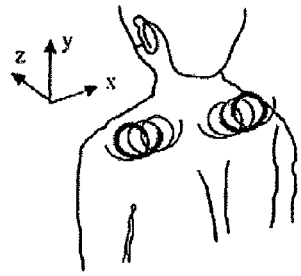
Figure 22:
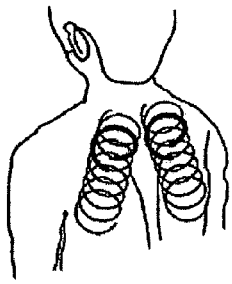
FIG. 22 is a schematic view illustrating another progressive massage pattern realized by the device.

FIG. 16 illustrates another set of the sinusoidal waveforms which realizes a progressively moving loop pattern of FIG. 17 along which the applicator 30 moves for giving an optimum massage action over an extended portion of the user's body, as shown in FIG. 18. In this instance, the sinusoidal waveform for the speed along the y-axis is selected to have a phase shift of 90° in relation to the speed along the x-axis and a reduced cycle (T2) less than that (T1) of the speed along the x-axis, and further configured to have different maximum values (V1 and V2) for the forward and backward speed along the y-axis. In the illustrated example, the forward speed (V1), i.e., the speed for moving the applicator upward is greater than the backward speed (V2), the speed for moving the applicator downward to progressively move the loop path upward. On the other hand, when V2 is set to be greater than V1, the resulting progressive loop path advances downward. Likewise, as shown in FIG. 19, when the sinusoidal waveform of the speed along the x-axis is configured to have the different maximum values (V3>V4) for the forward and backward speeds along the x-axis, the resulting progressive loop path moves along the x-axis, as shown in FIGS. 20 and 21. Further, when the both of the sinusoidal waveforms of the speeds along the x- and y-axes are configured to have the different maximum values for the forward and backward speeds respectively along the x- and y-axes, the resulting progressive loop path moves along an inclined line, as shown in FIG. 22.

Figure 23:
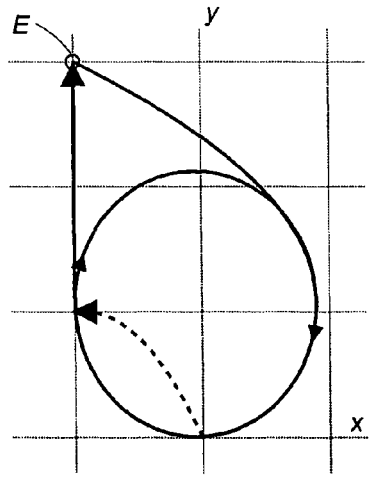
FIG. 23 is a schematic view illustrating a scheme of ending the massage action.
Figure 24:
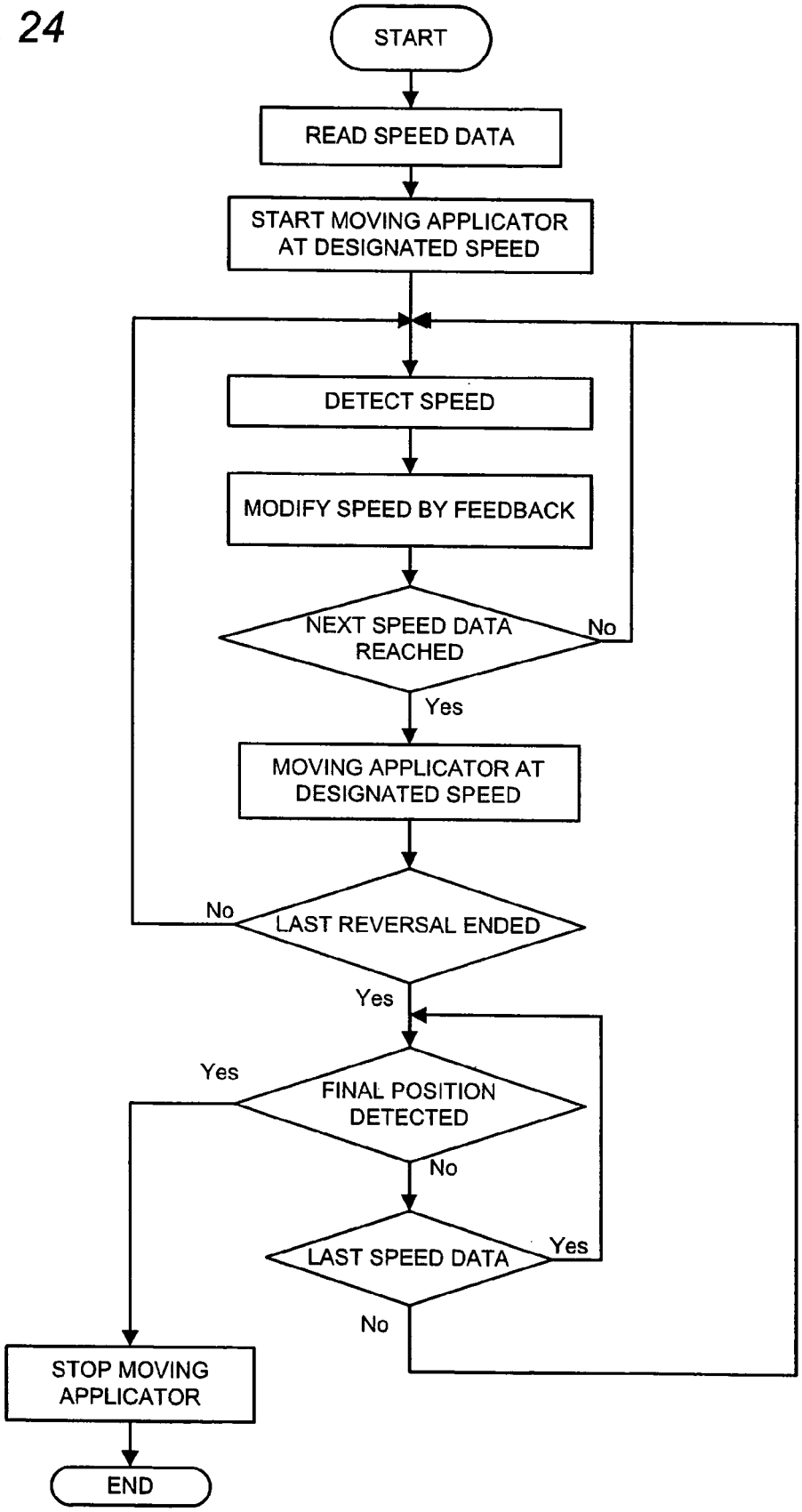
FIG. 24 is a flow-chart illustrating the sequence of ending the massaging action.

FIGS. 23 and 24 show a preferred scheme of ending the combined massage action. It is noted in this connection that the controller 100 is configured to designate an end position (E) for each of the selected massage patterns where the applicator 30 stops after completing the selected massage pattern. For example, when the circular massage pattern is selected, the end position (E) is defined to lies on a tangent line of a circular path to be traced by the applicator, as shown in FIG. 23. With the provision of thus defined end position (E), one of the transitional movement, in this case, along the y-axis is terminated only after the completion of the transitional movement along the other axis (x-axis). Therefore, it is possible to avoid undesired jerky movement of the applicator as indicated by dotted lines in FIG. 23 immediately before the stopping of the applicator. Such jerky movement would cause a stinging and painful massage and should be therefore avoided. In order to stop the applicator finally at the end position (E), the speed controller 110 executes the steps as shown in the flow-chart of FIG. 24, which is basically identical to the flow chart of FIG. 10 except for a sequence of ending the massage action. When the speed of the applicator along each of two axes (x- and y-axes) sees a last reversal of direction, i.e., the applicator is caused to reverse its direction along each of the two axes at a last time designated by the speed data, the controller checks whether the final position (E) is reached with respect to the associated axis. When the final position (E) is reached, the controller stops moving the applicator along the corresponding axis. When the final position is not detected, it is further checked whether or not the current speed is a last speed data defined in the time-series speed data. When the controller acknowledges that the current speed is the last speed data, a sequence goes back to the step of checking the final position. On the other hand, when the current speed is not the last speed data, a sequence goes back to the step of moving the applicator at the designated speed. With the above sequence, the movement of the applicator along one of the axes is stopped later than that along the other axis such that the applicator advances to the end position (E) after completing the loop path and tracing the tangential line from the circumference of the loop path, avoiding the stinging movement as indicated by the dotted lines in FIG. 23.

Figure 25A:
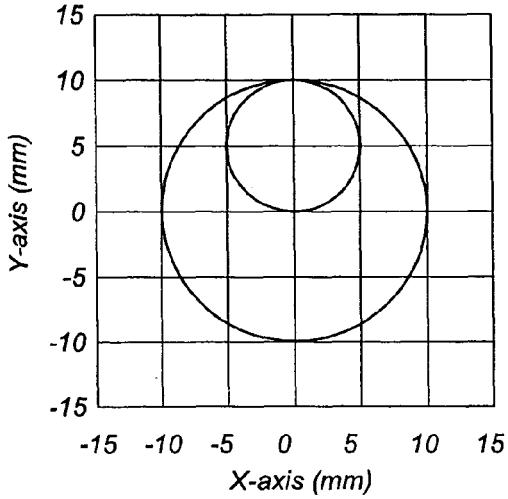
FIGS. 25A and 25B are views illustrating respectively a double loop path to be traced by the applicator and waveforms of the applicators' movements realizing the loop path.
Figure 25B:
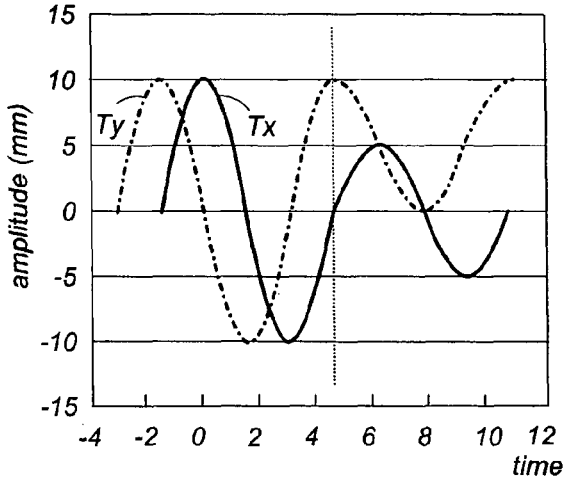

The device of the present invention can be configured to make various controls for driving the applicator in a double loop path with circles of different diameters. FIGS. 25A and 25B illustrate one of the controls in which the amount of the transitional movement Tx and Ty or speed along X-axis and Y-axis varies each cycle with a phase shift of 45° between the sinusoidal displacement curves of Tx and Ty. One of the sinusoidal displacement curves remains about a common zero amplitude, while the other curves has its center of oscillation shifting each cycle between the zero and an offset value. Thus, the applicator 30 repeats tracing a large circle of e.g. 10 mm diameter and a small circle of e.g. 5 mm diameter which is inscribed at its top on the large circle, as shown in FIG. 25A.

Figure 26A:
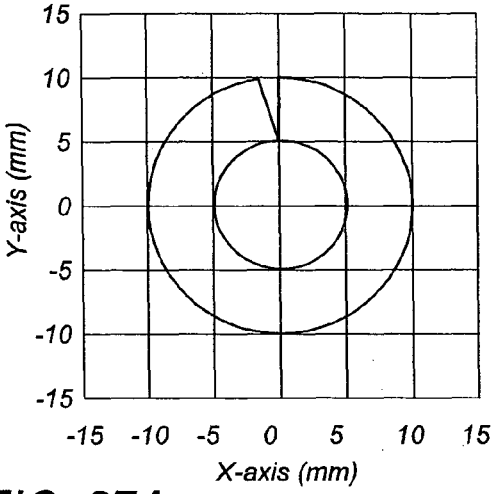
FIGS. 26A and 26B are views illustrating respectively another double loop path to be traced by the applicator and waveforms of the applicators' movements realizing the loop path.
Figure 28A:
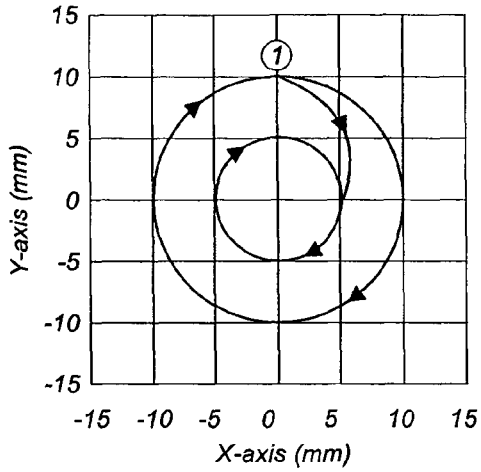
FIGS. 28A and 28B are views illustrating respectively a still further double loop path to be traced by the applicator and waveforms of the applicators' movements realizing the loop path.
Figure 28B:
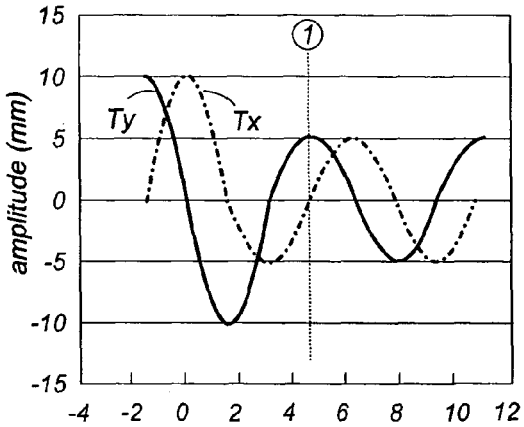

FIGS. 26A and 28B illustrate another control of driving the applicator to trace two concentric circles of different diameters. In this instance, the amplitudes or the speeds of the movements Tx and Ty along the x-axis and y-axis are configured to vary each cycle about the common zero amplitude. One of the amplitudes, e.g. Tx varies smoothly at the zero amplitude, while the other amplitude, e.g., Ty varying abruptly. The sinusoidal curves of the two movements are phase-shifted by 45°.

Figure 26B:
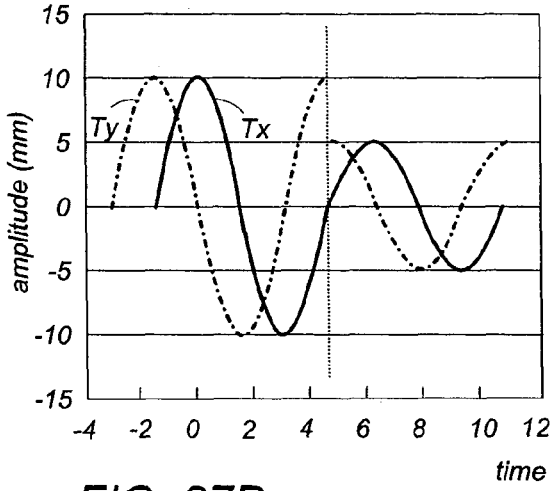
Figure 27A:
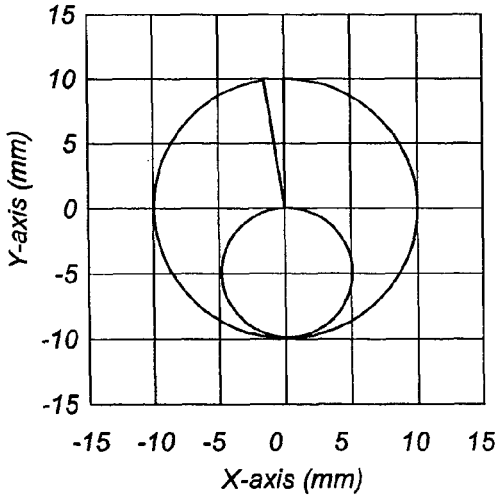
FIGS. 27A and 27B are views illustrating respectively a further double loop path to be traced by the applicator and waveforms of the applicators' movements realizing the loop path.
Figure 27B:
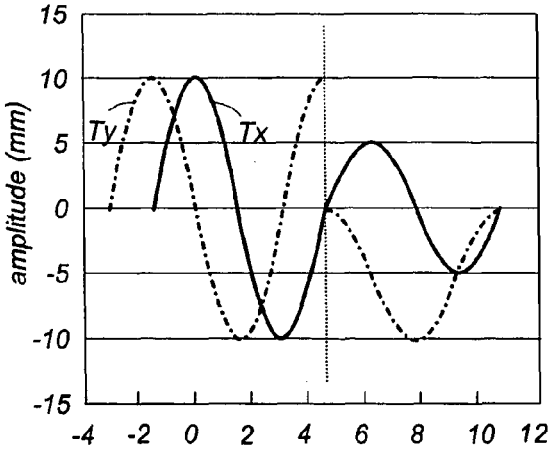

FIGS. 27A and 27B illustrate a further control which is similar to that shown in FIGS. 25A and 26B except that it is made to trace the small circle inscribed at its bottom on the large circle. In this instance, one of the sinusoidal curves, i.e., for the movement Ty has its center of oscillation shifted each cycle between zero and a lower offset value, while varying the amplitude of the movement abruptly between the cycles.

FIGS. 28A and 28B as illustrate a still further control of driving the applicator to trace a large circle and subsequently a small concentric circle through a smooth transition path. In this instance, both of the sinusoidal curves of the movement Tx and Ty or speed along the x-axis and y-axis are configured to vary the respective amplitude from one cycle to the subsequent cycle with the phase shift of 45° therebetween. Each of the sinusoidal curves is made continuous to move the applicator from a point (1) on the large circle smoothly to the small circle.

Figure 29A:
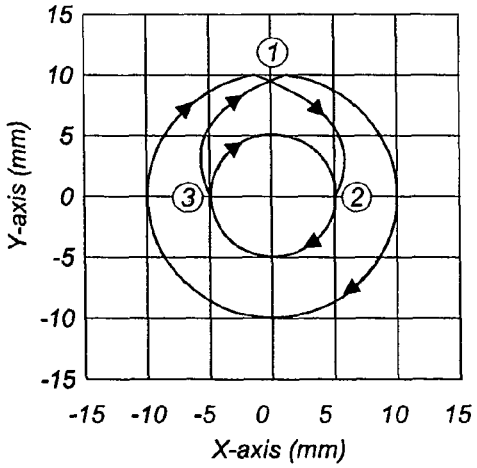
FIGS. 29A and 29B are views illustrating respectively a further double loop path to be traced by the applicator and waveforms of the applicators' movements realizing the loop path.
Figure 29B:
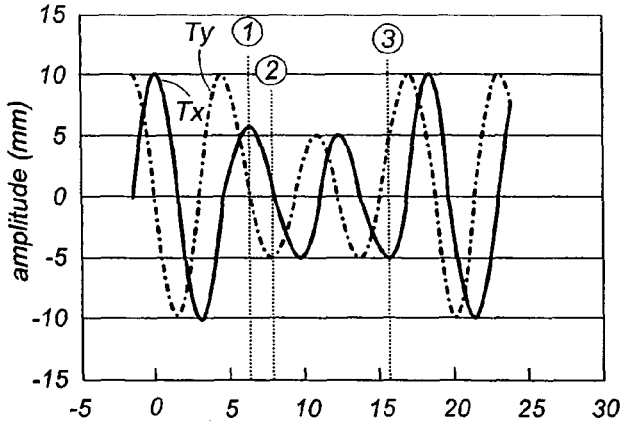

FIGS. 29A and 29B illustrate a further control which is similar to that of FIGS. 28A and 28B except for driving the applicator to repeat tracing the large circle and the small circle over a number of cycles. In this instance, the applicator is cause to move from a point (1) after tracing the large circle first to a point (2) on the small circle, and subsequently trace the small circle followed by moving from a point (3) back to the large circle.

Figure 30A:
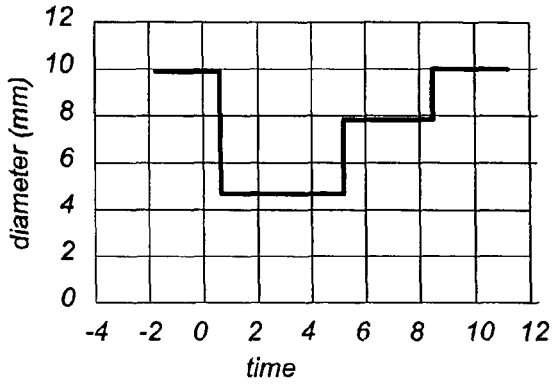
FIGS. 30A and 30B are graphs respectively illustrating the manner of varying the diameter of the loop path to be traced by the applicator.
Figure 30B:
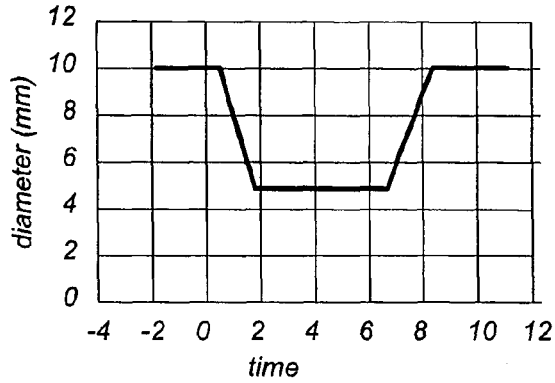

The device of the present invention may be configured to vary the diameter of the loop path stepwise as shown in FIG. 30A or continuously as shown in FIG. 30B.

Figure 31A:
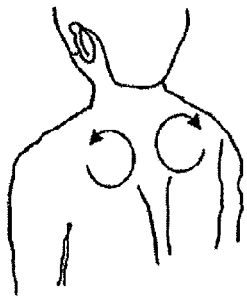
FIGS. 31A and 31B are schematic views respectively illustrating massage actions to be applied to the human body.
Figure 31B:
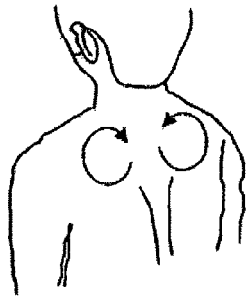

In view of that the device includes a pair of horizontally spaced applicators 30 respectively carried on the cradles 32, it may be desired to move the applicators to trace the respective loop path in opposite direction with each other, as shown in FIGS. 31A and 31B, for enhanced massage actions simultaneously on spaced spots. In order to make the massage in this fashion, a control is made to use the symmetrical sinusoidal curves for driving the applicators.

Figure 32:
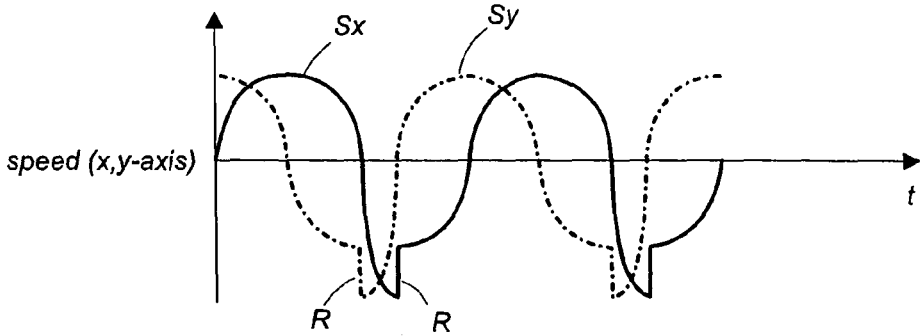
FIG. 32 is a waveform chart illustrating another control of periodically applying a strong point-pressing force.

Further, the device may be configured to give a strong point-pressing force periodically while making the loop massage as explained in the above. For this purpose, the speed curves Sx and Sy of the movements respectively along the x-axis and y-axis are each shaped to have a ripple (R) of accelerating the speed within one cycle, as shown in FIG. 32. Thus, the applicator is driven to be accelerated when reaching a point on the loop path, thereby giving the strong point-pressing force periodically.

Figure 33A:
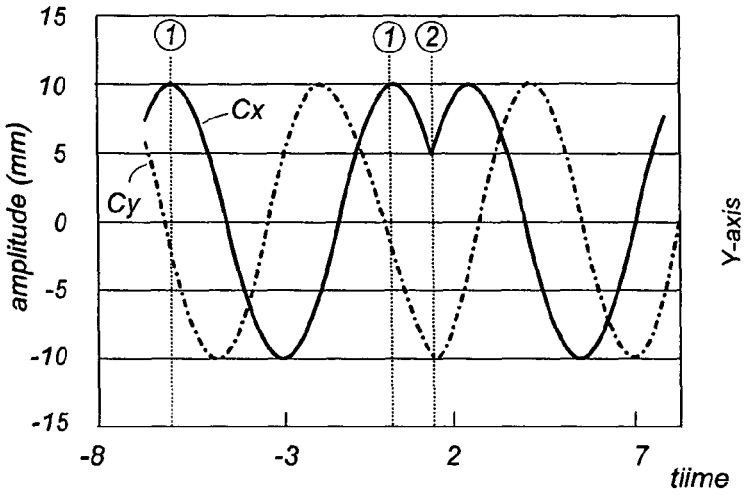
FIGS. 33A and 33B are views respectively illustrating a waveform of the applicator's movement and a resulting loop path traced by the applicator.
Figure 33B:
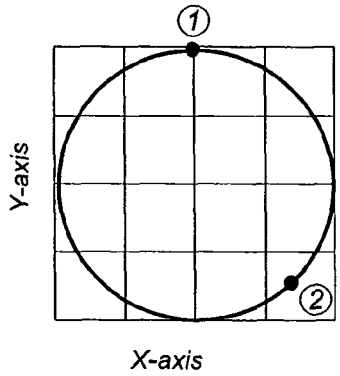

FIGS. 33A and 33B illustrates another control of moving the applicator to move along the circular path repeatedly in opposite directions. In this control, when the applicator moves to a point (2) after moving in one direction past a point (1) once or more, the applicator moves in the opposite direction. The sinusoidal curves Cx and Cy for the movement respectively along the x-axis and y-axis are phase-shifted by 90° or less.

Figure 34A:
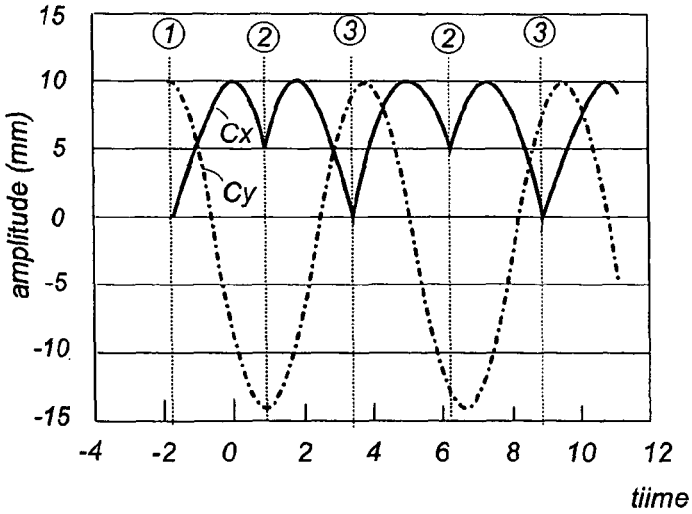
FIGS. 34A and 34B are views respectively illustrating another waveform of the applicator's movement and a resulting loop path traced by the applicator.
Figure 34B:
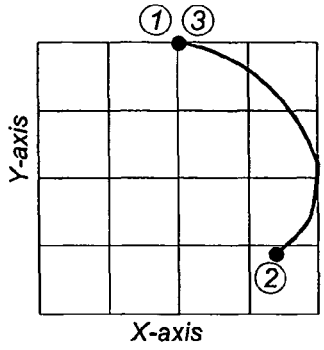

Although the applicator is drive to move the loop path in the above embodiment, it may be configured to move along an arcuate path, i.e., a portion of the circular path, repeatedly in opposite directions, as shown in FIGS. 34A and 34B. In this instance, the sinusoidal curves Cx and Cy for the movements along the x-axis and y-axis are shaped to define a start point (1), reverse points (2) and (3) at the opposite ends of the arcuate path. The speed curves Sx and Sy are phase-shifted by 90° with one of the curve Cx, being shaped to have its one-half cycle reversed. With this control, the applicator moves from the start point (1) along the arcuate path to the second point (2) where it is reversed in the direction to move back to point (3) and is again reversed.

In the above embodiment, the movement of the applicator is explained only with respect to the x-axis and y-axis for simplicity, the present invention should not be interpreted to be limited thereto and encompass a control of adding the reciprocating movement of the applicator along the z-axis to give a three-dimensional movement to the applicator, and even the combined movement in the x-z plane or y-z plane.

This application is based upon and claims the priority of Japanese Patent Application No. 2006-010511, filed in Japan on Jan. 18, 2006 and Japanese Patent Application No. 2006-023593, filed in Japan on Jan. 31, 2006, the entire contents of which are expressly incorporated by reference herein.

The invention claimed is:

1. A massaging device, comprising:

an applicator configured to come into contact with a user's body;

a plurality of driving units coupled to said applicator to give different reciprocating movements to said applicator respectively along different axes, thereby generating a combined massaging motion to be applied to the user's body;

a controller configured to hold individual speed data each defining a speed at which each of said driving unit reciprocates said applicator along each of said different axes, and to control said driving units to reciprocate said applicator respectively in accordance with the associated speed data, wherein said controller is configured to control the speed of said applicator moving along one of said axes independently from the speed of said applicator moving along another of said axes, wherein said speed data of the reciprocating movement along one of said axes is configured to give a reverse point which is shifted with respect to time in relation to the reciprocating movement along another of said axes, and wherein said speed data for the reciprocating movement of said applicator along two of said axes are configured to vary the speed respectively along sinusoidal curves, one of said sinusoidal curves having a phase shifted by 45° to 90° with respect to that of the other sinusoidal curve.

2. A massaging device as set forth in claim 1, wherein said sinusoidal curves for the respective movements along said two axes are selected to give a loop path having a diameter of 20 mm or less to be traced by said applicator.

3. A massaging device as set forth in claim 1, wherein each of said sinusoidal curves for the respective movement along said two axes are configured to vary at least one of its cycle and amplitude with respect to time.

4. A massaging device as set forth in claim 1, wherein each of said sinusoidal curves is selected to have a cycle of 2 seconds or less.

5. A massaging device as set forth in claim 1, wherein said sinusoidal curves for the respective movements along said two axes are selected to give a continuously coiled loop path to be traced by said applicator, said continuously coiled loop path having a center point moving along one of said two axes.

6. A massaging device as set forth in claim 1, wherein said controller holds additional speed data for reciprocating said applicator along an additional axes perpendicular to each of said two axes, said additional speed data being configured to give a three-dimensional path to be traced by said applicator.

* * * * *